US011464090B1

(12) United States Patent
Lin et al.

(10) Patent No.: US 11,464,090 B1
(45) Date of Patent: Oct. 4, 2022

(54) LIGHT STRING WITH CONSTANT-CURRENT RECTIFICATION

(71) Applicant: ZHANGZHOU GO WIN LIGHTING CO., LTD, Zhangzhou (CN)

(72) Inventors: Xiongzhong Lin, Zhangzhou (CN); Bihai Wang, Zhangzhou (CN); Yao Liu, Zhangzhou (CN)

(73) Assignee: ZHANGZHOU GO WIN LIGHTING CO., LTD, Zhangzhou (CN)

( * ) Notice: Subject to any disclaimer, the term of this patent is extended or adjusted under 35 U.S.C. 154(b) by 0 days.

(21) Appl. No.: 17/536,086

(22) Filed: Nov. 28, 2021

(30) Foreign Application Priority Data

Nov. 5, 2021 (CN) ..... 202122704575.X

(51) Int. Cl.
*H05B 45/00* (2022.01)
*H05B 45/345* (2020.01)

(52) U.S. Cl.
CPC ..... *H05B 45/345* (2020.01)

(58) Field of Classification Search
CPC ..... H05B 45/00; H05B 45/10; H05B 45/30; H05B 45/345; H05B 45/40; H05B 45/54; H05B 47/10; H05B 47/105
See application file for complete search history.

(56) References Cited

U.S. PATENT DOCUMENTS 7,609,006 B2 * 10/2009 Gibboney ..... H05B 45/00 315/185 S
8,314,564 B2 * 11/2012 Yu ..... H05B 45/37 315/185 S
2008/0106212 A1 * 5/2008 Yen ..... H05B 45/30 315/192

* cited by examiner

*Primary Examiner* — Jimmy T Vu

(57) ABSTRACT

A light string with constant-current rectification includes a first constant-current rectification module, a second constant-current rectification module, and a light string formed by a plurality of light-emitting diodes connected in series. The first constant-current rectification module and the second constant-current rectification module each include rectifier diodes and a regulating circuit that maintains a constant current, an output terminal of the first constant-current rectification module is connected to an anode of the light string, and an input terminal of the first constant-current rectification module is connected to a power supply, an output terminal of the second constant-current rectification module is connected to a cathode of the light string, and a pair of conduction wires are connected between the input terminal of the first constant-current rectification module and the input terminal of the second constant-current rectification module.

10 Claims, 3 Drawing Sheets

AC220V_L
AC220V_N
AC220V_L
AC220V_N
D1
D2
D3
D4
D5
D6
D7
D8
D9
D10
D11
D12
D13
D14
D15
D16
D17
D18
D19
D20
D21
D22
D23
D24
D25
D26
D27
D28
D29
D30
D31
D32
D33
D34
D35
D36
D37
D38
D39
D40

LIGHT STRING WITH CONSTANT-CURRENT RECTIFICATION

CROSS REFERENCE TO RELATED APPLICATIONS

This application is based upon and claims priority to Chinese Patent Application No. 202122704575.X, filed on Nov. 5, 2021, the entire content of which is incorporated herein by reference.

TECHNICAL FIELD

The present disclosure relates to the technical field of decorative light strings, in particular to a light string with constant-current rectification.

BACKGROUND

Traditionally, in production, light strings having different numbers of LED are connected with different numbers of resistors in series to regulate the current and ensure that the light strings would work under normal state. The number and resistance of the resistors depend on practical requirements, such as working voltage and LED quantity etc. As a result, the light strings of different specifications cannot be produced in a unified manner, which greatly affects the production efficiency.

SUMMARY OF DISCLOSURE

The present disclosure aims to overcome the drawbacks of the prior art, and provides a light string with constant-current rectification, which can solve the problem that the traditional light strings of different specifications cannot be uniformly manufactured in the production process.

In order to achieve the above objectives, the present disclosure provides the following technical solutions. A light string with constant-current rectification includes a first constant-current rectification module, a second constant-current rectification module, and a light string formed by a plurality of light-emitting diodes connected in series. The first constant-current rectification module and the second constant-current rectification module each include a rectifier diode and a regulating circuit that maintains a constant current. An output terminal of the first constant-current rectification module is connected to an anode of the light string, and an input terminal of the first constant-current rectification module is connected to a power supply. An output terminal of the second constant-current rectification module is connected to a cathode of the light string, and a pair of conduction wires are connected between the input terminal of the first constant-current rectification module and the input terminal of the second constant-current rectification module.

In some embodiments, the first constant-current rectification module includes a first diode, a second diode, and a first regulating circuit that maintains the constant current. A cathode of the first diode and a cathode of the second diode are both electrically connected to an anode of the first regulating circuit. An anode of the first diode and an anode of the second diode are respectively connected to a positive port and a negative port of the power supply. A cathode of the first regulating circuit is connected to the anode of the light string.

In some embodiments, the second constant-current rectification module includes a third diode, a fourth diode, and a second regulating circuit that maintains the constant current. An anode of the third diode and an anode the fourth diode are both electrically connected to a cathode of the second regulating circuit. An anode of the second regulating circuit is connected to the cathode of the light string. A cathode of the third diode and a cathode of the fourth diode are connected to a pair of backup ports and are respectively connected in parallel to a zero wire port and a live wire port of the power supply through the pair of conduction wires.

In some embodiments, the first regulating circuit and the second regulating circuit are each composed of a constant-current diode.

In some embodiments, the first regulating circuit and the second regulating circuit are each composed of a resistor and a constant-current chip connected in series.

In some embodiments, the constant-current chip includes an input terminal, an output terminal, and an adjustable input terminal. The input terminal is connected to the cathode of the first diode and the cathode of the second diode. The output terminal is connected in series to the resistor and then to the anode of the light string. The adjustable input terminal is connected to a point between the output terminal and the resistor.

In some embodiments, the first diode, the second diode, and the first regulating circuit are arranged on a first circuit board. The first circuit board is provided with a Y-shaped groove, and the Y-shaped groove includes a first slit and a second slit respectively extending to a left edge and a right edge of the first circuit board, and further includes a third slit extending from an intersection of the first slit and the second slit to a rear edge of the first circuit board. The first diode and the second diode are respectively positioned across gaps of the first slit and the second slit and located on two sides of the third slit. The first regulating circuit is disposed on a front side of the first circuit board opposite to a position of the third slit.

In some embodiments, the third diode, the fourth diode, and the second constant-current circuit are arranged on a second circuit board, and the second circuit board has a shape and a configuration of elements identical to that of the first circuit board but in a mirror symmetry with the first circuit board.

In some embodiments, the first constant-current rectification module and the second constant-current rectification module are injection molded and encapsulated by one or more materials selected from the group consisting of PS, PVC, PE, PP, PMMA, or ABS.

The present disclosure has the following advantages. The light string with constant-current rectification of the present disclosure is provided with regulating circuits that maintain constant current inside the common cathode rectification module and the common anode rectification module, so as to remove the resistors for voltage dividing and current limiting connected in the traditional light string. As a result, the present disclosure may realize a mass and continuous production of long light strings in a unified manner, thereby saving time for twisting wires, overcoming poor welding caused by connecting a large number of resistors, and improving versatility and operating voltage range.

Figure 1:
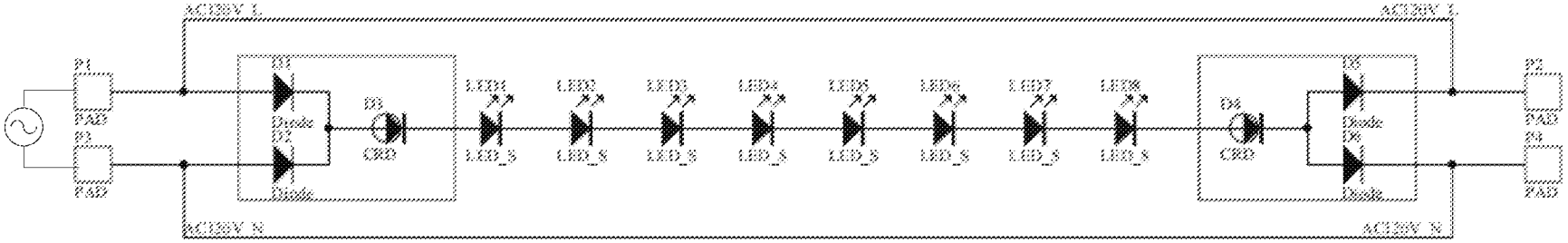
FIG. 1 is a schematic circuit diagram of a light string with constant-current rectification according to one embodiment of the present disclosure.
Figure 2:
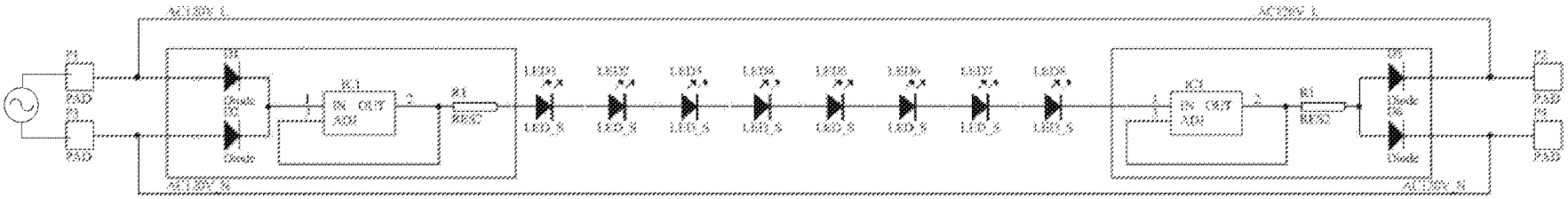
FIG. 2 is a schematic circuit diagram of a light string with constant-current rectification according to another embodiment of the present disclosure.
Figure 3:
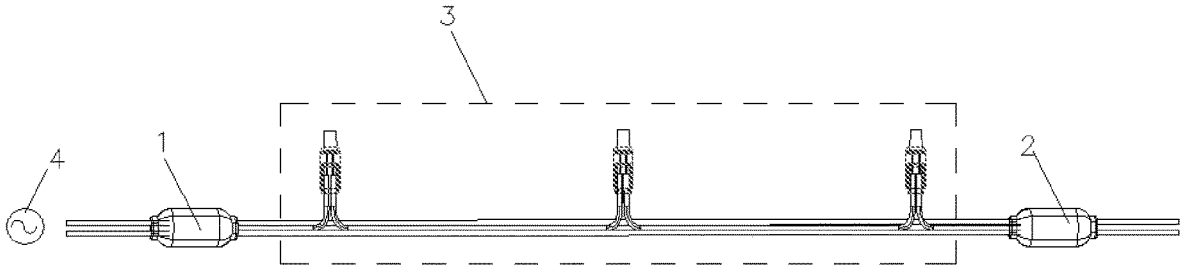
FIG. 3 is a structural diagram of a light string with constant-current rectification according to one embodiment of the present disclosure.
Figure 4:
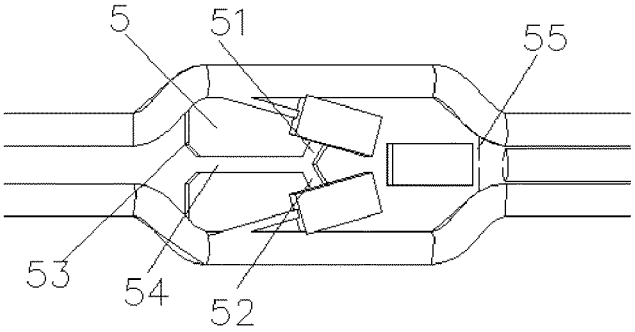
FIG. 4 is a structural diagram of a first circuit board of a light string with constant-current rectification according to one embodiment of the present invention.
Figure 5:
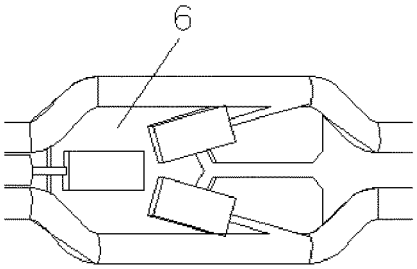
FIG. 5 is a structural diagram of a second circuit board of the light string with constant-current rectification according to one embodiment of the present disclosure.

The realization of the objectives, functional characteristics and advantages of the present disclosure will be further described in conjunction with the embodiments and with reference to the accompanying drawings hereinafter.

DETAILED DESCRIPTION OF THE EMBODIMENTS

In order to make the objectives, technical solutions, and advantages of the embodiments of the present disclosure clearer, the technical solutions of the embodiments of the present disclosure will be described clearly and completely below with reference to the drawings of the embodiments of the present disclosure. Obviously, the described embodiments are parts of, but not all of, the embodiments of the present disclosure. Based on the embodiments of the present disclosure, all other embodiments derived by those of ordinary skills in the art without creative effort fall within the scope of protection of the present disclosure. Accordingly, the following detailed description of the embodiments of the present disclosure shown in the drawings is not intended to limit the scope of protection of the present disclosure, but merely to represent selected embodiments of the present disclosure. Based on the embodiments of the present disclosure, all other embodiments derived by those of ordinary skills in the art without creative effort fall within the scope of protection of the present disclosure.

In the description of the present disclosure, the terms "first", "second" are used only for descriptive purposes and cannot be understood as indicating or implying relative importance or implying the number of indicated technical features. Thus, a characteristic that is referred to by "first" and "second" may include, expressly or implicitly, one or more of the characteristics. Also, it should be noted that the terms of "up", "down", "inside/inner", "outside/outer", "front end", "rear end", "two ends", "one end", "another end", "one side", "another side" for indicating the location or orientation are based on the location or orientation shown in the drawings for the sake of simplifying the description of the present disclosure, rather than indicate or imply that the indicated device or component must have specific location or orientation, or be constructed and operated by specific orientation. These terms should not be understood as limits to the present disclosure.

In the description of the present disclosure, it should be noted that, unless otherwise clearly defined, the terms "provide/arrange", "connect", etc. should be understood in a broad sense. For example, "connect" may be interpreted as a fixed connection, a detachable connection, or an integrated connection, it may also be interpreted as a mechanical connection or an electrical connection, or a direct connection or an indirect connection through an intermediate medium. Optionally, it may refer to the communication of two components. For those of ordinary skill in the art, the meaning of the above-mentioned terms in the present disclosure should be understood under specific circumstances.

The content of the present disclosure will be described in detail below in terms of the embodiments.

Embodiment 1

With reference to FIGS. 1-5, one of the embodiments of the present disclosure provides a light string with constant-current rectification, which includes a first constant-current rectification module 1, a second constant-current rectification module 2, and a light string formed by a plurality of light-emitting diodes connected in series. The first constant-current rectification module 1 and the second constant-current rectification module 2 each include a rectifier diode and a regulating circuit that maintains a constant current. An output terminal of the first constant-current rectification module 1 is connected to a anode of the light string 3, and an input terminal of the first constant-current rectification module 1 is connected to a power supply 4. An output terminal of the second constant-current rectification module 2 is connected to a cathode of the light string 3. A pair of conduction wires are connected between the input terminal of the first constant-current rectification module 1 and the input terminal of the second constant-current rectification module 2. In this embodiment, the power supply 4 may be an AC power source, and the first constant-current rectification module 1 and the second constant-current rectification module 2 jointly form a bridge rectifier circuit to convert the AC power into DC power for the light string 3 to use.

In some embodiments, the first constant-current rectification module 1 includes a first diode D1, a second diode D2, and a first regulating circuit that maintains the constant current. In this embodiment, the first regulating circuit is composed of one constant-current diode D3. It should be noted that the first regulating circuit may also be other circuits that can regulate the circuit to maintain a constant current, such as a constant-current circuit composed of resistor and transistor or a constant-current chip, etc. In some embodiments, the first regulating circuit or the second regulating circuit may also be composed of a constant-current chip IC1 connected in series with a resistor R1. The constant-current chip IC1 includes an input terminal IN, an output terminal OUT, and an adjustable input terminal ADJ. The input terminal IN is connected to the cathodes of the first diode D1 and the second diode D2, the output terminal OUT is connected in series with a resistor R1 and then to the anode of the light string 3, and the adjustable input terminal ADJ is connected to a point between the output terminal OUT and the resistor R1. The cathode of the first diode D1 and the cathode of the second diode D2 are both electrically connected to the anode of the constant-current diode D3. The anode of the first diode D1 and the anode of the second diode D2 are respectively connected to the positive and negative ports of the power supply 4. Specifically, the anode of the first diode D1 is connected to the positive port of the power supply 4, and the anode of the second diode D2 is connected to the negative port of the power supply 4. The cathode of the constant-current diode D3 is connected to the anode of the light string 3.

In some embodiments, the second constant-current rectification module 2 includes a third diode D5, a fourth diode D6, and a second regulating circuit for maintaining constant current. In this embodiment, the second regulating circuit may also be composed of one constant-current diode D4. It should be noted that, as mentioned above, the second regulating circuit may also be other circuits that can regulate the circuit to maintain a constant current, such as a regulating circuit composed of resistor and transistor or a constant-current chip etc. The anodes of the third diode D5 and the fourth diode D6 are both electrically connected to the cathode of the constant-current diode D4, and the anode of the constant-current diode D4 is connected to the cathode of the light string 3. The cathodes of the third diode D4 and the fourth diode D5 are connected to a pair of backup ports P2, P4 and are respectively connected in parallel to a zero wire port and a live wire port of the power supply through the pair of conduction wires. Other light strings maybe connected through the backup ports P2 and P4 to realize the expansion of the length of the light string.

In some embodiments, the first diode D1, the second diode D2 and the first regulating circuit are arranged on the first circuit board 5. The first circuit board 5 is provided with a Y-shaped groove, and the Y-shaped groove includes a first slit 51 and a second slit 52 respectively extending to the left and right edges of the first circuit board 5, and further includes a third slit 54 extending from the intersection point of the first slit 51 and the second slit 52 to a rear edge 53 of the first circuit board. The first diode D1 and the second diode D2 are respectively positioned across gaps of the first slit 51 and the second slit 52 and located on two sides of the third slit 54. The regulating circuit is disposed on the front side 55 of the first circuit board opposite to a position of the third slit 54. In this embodiment, the arrangement of the Y-shaped groove may physically isolate and increase the distance between the pins of the first diode D1 and the second diode D2, effectively reducing the probability of short-circuits caused by soldering. The soldering method may be reflow soldering or manual soldering. The first slit and the second slit may also increase the creepage distance. Specifically, the width of the first slit and the second slit may be 1-3 mm, preferably 1.5 mm.

In some embodiments, the third diode D5, the fourth diode D6 and the second regulating circuit are arranged on a second circuit board 6. The second circuit board 6 has a shape and a configuration of elements identical to that of the first circuit board 5 but in a mirror symmetry with the first circuit board 5.

In some embodiments, the first constant-current rectification module 1 and the second constant-current rectification module 2 are respectively injection molded and encapsulated by one or more materials selected from the group consisting of PS, PVC, PE, PP, PMMA or ABS. The encapsulation molding may be a one-step injection molding, which may save material and cost and have a smaller volume compared with the traditional two-step injection molding.

Embodiment 2

Figure 6:
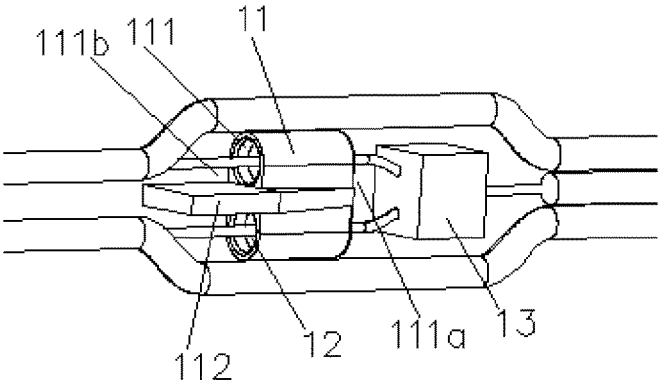
FIG. 6 is a structural diagram of a first constant-current rectification module of a light string with constant-current rectification according to another embodiment of the present disclosure.

The difference between this embodiment and embodiment 1 is that in this embodiment, the electronic components of the first constant-current rectification module 1 and the second constant-current rectification module 2 may be surface mounted or plugged in. When the electronic components are surface mounted, the rectifier diode and the regulating circuit are both mounted on the surface of a printed circuit board (PCB) or a substrate by surface mounted technology, and then are subjected to reflow soldering or dip soldering. When the plug-in connection is adopted, no circuit board is required. The structure of the plug-in connection will be described in detail below, but it should be noted that the plug-in connection is merely a specific implementation of the present disclosure, and the scope of the present disclosure is not limited thereto. Specifically, as shown in FIG. 6, taking the first constant-current rectification module 1 as an example, it includes a mounting bracket 11, rectifier diodes 12, and a regulating circuit 13. In some embodiments, the mounting bracket 11 includes two chambers 111 separated from each other and arranged side by side, and the rectifier diodes 12 are respectively installed in the two chambers 111. The cathode pins of the two rectifier diodes 12 extend to the front side 111*a* and are simultaneously connected to the input terminal of the regulating circuit 13, and the anode pins of the two rectifier diodes 12 extend to the rear side 111*b* and are respectively connected to the live and null ports of the power supply. The mounting bracket 11 also includes a partition 112 arranged between the two anode pins. The partition 112 may prevent the two pins from being short-circuited during soldering, thereby improving the product yield and production efficiency. The second constant-current rectification module 2 may have a structure identical to that of the first constant-current rectification module 1 which is in a mirror symmetry with the first constant-current rectification module 1.

According to another aspect of the present disclosure, a method of manufacturing a light string with constant-current rectification is provided which includes the following steps:

continuously manufacturing a long light string formed by connecting a number of light-emitting diodes in series without resistors;

cutting off a light string segment from the long light string and connecting a first constant-current rectification module and a second constant-current rectification module to two ends of the light string segment respectively; wherein the first constant-current rectification module and the second constant-current rectification module each include rectifier diodes and a regulating circuit that maintains a constant current;

connecting an output terminal of the first constant-current rectification module to an anode of the light string segment and connecting an input terminal of the first constant-current rectification module to a power supply; and connecting an output terminal of the second constant-current rectification module to a cathode of the light string and connecting a pair of conduction wires between the input terminal of the first constant-current rectification module and the input terminal of the second constant-current rectification module.

The present disclosure does not need to connect resistors to the light string for voltage dividing and current limiting as a regulating circuit for maintaining a constant current is configured inside the common-cathode rectification module and the common-anode rectification module as shown in FIG. 1. By such a configuration, the light string may be produced continuously by a machine without the limit of different specifications, when the required number of LED in an individual light string or the working voltage is different, continuously manufactured light string maybe cut according to the required number of LED. Then, the light string is connected with the first constant-current rectification module 1 and the second constant-current rectification module 2. Therefore, the present disclosure may allow the manufacturer to continuously produce long light strings, thereby saving wire twisting time (as the machine can be used for fully automatic wire twisting), overcoming the problem of poor welding caused by connecting a large number of resistors, and having a better versatility. This circuit can be used not only on AC-powered lines, but also on DC-powered lines.

The implementations in the above embodiments may be further combined or replaced, and the embodiments merely describe the preferred embodiments of the present disclosure, without limiting the concept and scope of the present disclosure. All the changes and improvements made by those of ordinary skill in the art to the technical solution of the present disclosure without departing from the design concept of the present disclosure fall within the protection scope of the present disclosure.

What is claimed is:

1. A light string with constant-current rectification, comprising:

a first constant-current rectification module, a second constant-current rectification module, and a light string formed by a plurality of light-emitting diodes connected in series; wherein the first constant-current rectification module and the second constant-current rectification module each include rectifier diodes and a regulating circuit that maintains a constant current, an output terminal of the first constant-current rectification module is connected to an anode of the light string, and an input terminal of the first constant-current rectification module is connected to a power supply, an output terminal of the second constant-current rectification module is connected to a cathode of the light string, and a pair of conduction wires are connected between the input terminal of the first constant-current rectification module and the input terminal of the second constant-current rectification module.

2. The light string with constant-current rectification according to claim 1, wherein the first constant-current rectification module comprises a first diode, a second diode, and a first regulating circuit that maintains the constant current;

a cathode of the first diode and a cathode of the second diode are both electrically connected to an anode of the first regulating circuit, an anode of the first diode and an anode of the second diode are respectively connected to a positive port and a negative port of the power supply, and a cathode of the first regulating circuit is connected to the anode of the light string.

3. The light string with constant-current rectification according to claim 2, wherein the second constant-current rectification module comprises a third diode, a fourth diode, and a second regulating circuit that maintains the constant current;

an anode of the third diode and an anode the fourth diode are both electrically connected to a cathode of the second regulating circuit, an anode of the second regulating circuit is connected to the cathode of the light string, a cathode of the third diode and a cathode of the fourth diode are connected to a pair of backup ports and are respectively connected in parallel to a null line port and a live line port of the power supply through the pair of conduction wires.

4. The light string with constant-current rectification according to claim 3, wherein the first regulating circuit and the second regulating circuit are each composed of a constant-current diode.

5. The light string with constant-current rectification according to claim 3, wherein the first regulating circuit and the second regulating circuit are each composed of a resistor and a constant-current chip connected in series.

6. The light string with constant-current rectification according to claim 5, wherein the constant-current chip comprises an input terminal, an output terminal, and an adjustable input terminal;

the input terminal is connected to the cathode of the first diode and the cathode of the second diode, the output terminal is connected in series to a resistor and then to the anode of the light string, the adjustable input terminal is connected to a point between the output terminal and the resistor.

7. The light string with constant-current rectification according to claim 5, wherein the first diode, the second diode, and the first regulating circuit are arranged on a first circuit board, the first circuit board is provided with a Y-shaped groove, and the Y-shaped groove includes a first slit and a second slit respectively extending to a left edge and a right edge of the first circuit board, and includes a third slit extending from an intersection of the first slit and the second slit to a rear edge of the first circuit board, the first diode and the second diode are respectively positioned across gaps of the first slit and the second slit and located on two sides of the third slit, and the first regulating circuit is disposed on a front side of the first circuit board opposite to a position of the third slit.

8. The light string with constant-current rectification according to claim 7, wherein the third diode, the fourth diode, and the second constant-current circuit are arranged on a second circuit board, and the second circuit board has a shape and a configuration of elements identical to a shape and a configuration of the first circuit board but in a mirror symmetry with the first circuit board.

9. The light string with constant-current rectification according to claim 8, wherein the first constant-current rectification module and the second constant-current rectification module are injection molded and encapsulated by one or more materials selected from the group consisting of PS, PVC, PE, PP, PMMA, or ABS.

10. A method of manufacturing a light string with constant-current rectification comprising:

continuously manufacturing a long light string formed by connecting a number of light-emitting diodes in series without resistors;

cutting off a light string segment from the long light string and connecting a first constant-current rectification module and a second constant-current rectification module to two ends of the light string segment respectively; wherein the first constant-current rectification module and the second constant-current rectification module each include rectifier diodes and a regulating circuit that maintains a constant current;

connecting an output terminal of the first constant-current rectification module to an anode of the light string segment and connecting an input terminal of the first constant-current rectification module to a power supply; and connecting an output terminal of the second constant-current rectification module to a cathode of the light string and connecting a pair of conduction wires between the input terminal of the first constant-current rectification module and the input terminal of the second constant-current rectification module.

* * * * *